United States Patent [19]

Kitamura et al.

[11] Patent Number: 4,573,515

[45] Date of Patent: Mar. 4, 1986

[54] METHOD FOR ELECTROMAGNETICALLY STIRRING MOLTEN STEEL IN CONTINUOUS CASTING

[75] Inventors: Minoru Kitamura, Nishinomiya; Kenta Yoshii, Kakogawa; Shozo Kawasaki, Kobe; Katsuyoshi Matsuo, Kakogawa; Mitsuo Tomonaga, Himeji, all of Japan

[73] Assignee: Kabushiki Kaisha Kobe Seiko Sho, Kobe, Japan

[21] Appl. No.: 475,692

[22] Filed: Mar. 15, 1983

[51] Int. Cl.[4] ..... B22D 27/02

[52] U.S. Cl. ..... 164/468; 164/504

[58] Field of Search ..... 164/468, 504, 147.1, 164/499

[56] References Cited

FOREIGN PATENT DOCUMENTS 57-195567 12/1982 Japan ..... 164/468

*Primary Examiner*—Kuang Y. Lin

*Attorney, Agent, or Firm*—Oblon, Fisher, Spivak, McClelland & Maier

[57] ABSTRACT

A method for electromagnetically stirring molten steel in continuous casting wherein in producing cast slabs or blooms, an electromagnetic stirring force is applied to the unsolidified molten steel in the cast slab or bloom being drawn. An electromagnetic stirrer is installed between drawing positions where the unsolidified thickness is 45% and 15%, respectively, of the thickness as viewed in the direction of the thickness of the cast slab or bloom, and stirring in the casting direction is applied to the unsolidified molten steel in such a manner that the product of the magnetic flux density (gauss) at the interface between the unsolidified and solidified portions and the stirring time in minutes (which is defined as the ratio of the stirring effective length (mm) of the electromagnetic stirrer to the casting speed (m/min)) is 1,600 gauss-min or more per $m^3$ of the total volume ($m^3$) of unsolidified molten steel present in a region extending to the drawing side from the position where the electromagnetic stirrer is located.

2 Claims, 9 Drawing Figures

METHOD FOR ELECTROMAGNETICALLY STIRRING MOLTEN STEEL IN CONTINUOUS CASTING

BACKGROUND OF THE INVENTION

Field of the Invention

The present invention relates to an electromagnetic stirring method which provides a satisfactory solidified structure in continuous casting.

Besides Fe, molten steel contains various alloying elements and impurity elements, and the solidification of molten steel is sometimes attended by the remarkable segregation of segregative elements, such as C, P, and S, into the final solidifying portion of the steel ingot or cast slab and bloom. Products made of a material having such a segregated portion would have inferior product characteristics due to the non-ununiformity of their mechanical properties, and they would have case trouble during welding; thus it is important to decrease segregation. Particularly in continuous casting process, noticeable segregation develops in a direction at right angles with the cast slab and bloom drawing direction; however, past examination of various operating conditions have not been successful in improving the mechanical properties of the cast slab and bloom.

The most promising of the measures heretofore taken is to apply electromagnetic stirring to molten steel during solidification. Although this method has been recognized as having the effect of breaking to some extent the columnar crystals growing during solidification, such a degree of breaking of columnar crystals is insufficient for elimination of marked segregation. Thus, to enhance the stirring effect, an attempt has been made to increase the electromagnetic stirring force so as to provide an increased stirring force capacity, but it has the drawback of producing a white band in the form of negative segregation. The white band portion is not only lower in the percentages of alloying elements than their average values, forming a qualitative defect, but also presents an undesirable outside appearance.

The present invention, made with this serious situation in mind, is intended to establish electromagnetic stirring conditions for enhancing the effect of breaking columnar crystals to reduce negative segregation and avoid formation of white bands. Thus, the method of electromagnetically stirring molten steel in continuous casting according to the present invention is characterized in that an electromagnetic stirrer is installed between drawing positions where the unsolidified thickness is 45% and 15%, preferably 35% and 20%, respectively, of the thickness as viewed in the direction of the thickness of the cast slab and bloom, and in that where the magnetic flux density at the interface between the unsolidified and solidified portions (said interface being hereinafter referred to as the solidification interface) is represented by B (gauss), the stirring effective length of the electromagnetic stirrer by 1 (mm), the casting speed by v (m/min.), and the stirring time by T (min.) $=1/v$, stirring in the casting direction is applied in such a manner that the product $B \times T$ is 1,600 gauss-min. or more per $m^3$ of the total volume of the unsolidified molten steel present in a region extending to the drawing side from the position where the electromagnetic stirrer is located.

The aforesaid conditions have been determined with the flow condition of molten steel during solidification taken into account. The arrangement and functions and effects of the invention will now be described along with the process of development of the invention.

In continuous casting, the cause of segregation taking place in the central portion of the cast slab and bloom is generally considered as follows.

It is known that although the central portion of the cast slab and bloom, when viewed in the casting direction (drawing direction), has very little temperature gradient, the flow of the solid-liquid coexistence layer in this portion can be induced by the so-called suction (a phenomenon of contraction of the solid-liquid coexistence layer taking place in the last stage of solidification of molten steel). However, all the solid-liquid coexistence layer does not flow at the same time, but owing to solidification contraction which proceeds in the lower region (on the drawing side), the region which overlies the same (mold side) flows downward, and as this flowing region solidifies, the region which overlies the same flows downward and solidifies; such stepwise flow is repeated, whereby the periodicity of V segregation is formed. This situation will now be further described. The solid-liquid coexistence condition is established in several regions along the cast slab and bloom drawing direction i.e., the casting direction and these regions flow in block but the flow of these regions takes place successively with some time lag, with the lower side flowing first. Therefore, between adjacent regions, the dendrites separate from each other in accordance with the flow time lag, so that cavities with some periodicity are formed. Such a cavity has a temperature gradient in a direction at right angles with the cast slab and bloom drawing direction and a flow of molten steel is formed between the dendrites, so that the aforesaid suction effect becomes greater toward the center of the cast slab and bloom. Under these influences, the aforesaid cavities assume a V-shape inclined toward the center axis, and it seems that the surrounding segregated liquid present between the dendrites flows into the V-shaped cavities, resulting in V segregation.

On the basis of this analysis, we thought we would attain reduction of segregation in the central portion of the cast slab and bloom by adjusting the electromagnetic stirring force so as to change the aforesaid solidification mechanism.

The region where V segregation takes place is, after all, a region with little temperature gradient. The factors which determine the size of this region are supposed to include the molten steel composition (particularly the carbon concentration) and superheating of molten steel, but a statistical examination of regions where V segregation is formed has revealed that even the maximum value does not exceed 45% of the thickness as viewed in the direction of the thickness of the cast bloom.

The invention will now be described in more detail with reference to the accompanying drawings.

Figure 1:
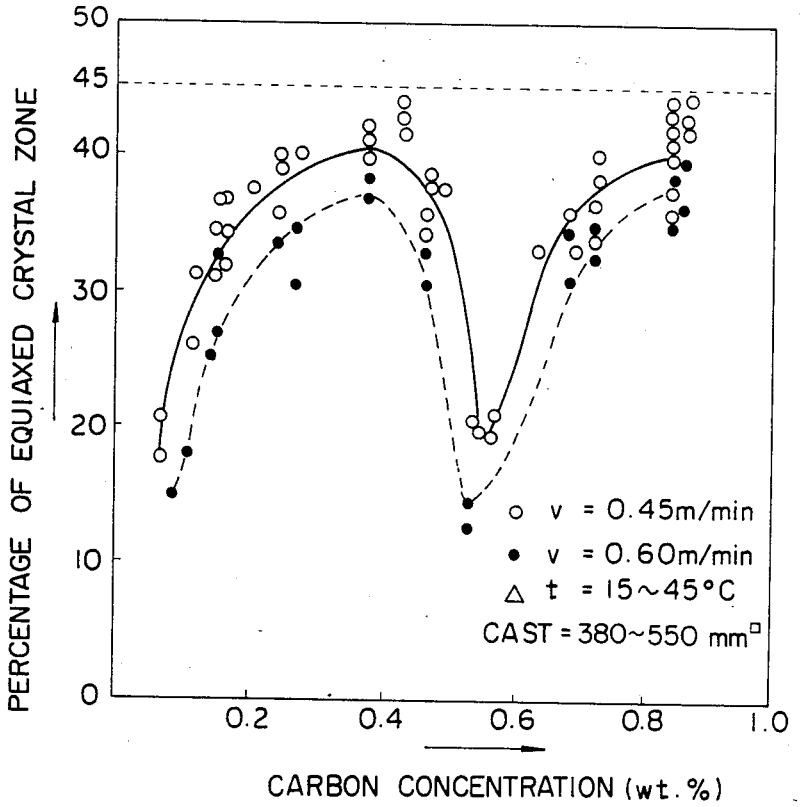
FIG. 1 is a graph showing the relationship between the carbon concentration and the percentage of equiaxed crystal zone on the upper curve side in continuous casting.

FIG. 1 is a graph showing the relationship between the carbon concentration in molten steel and percentage of equiaxed crystal zone on the upper curve side. As can be seen in the graph, the percentage of equiaxed crystal zone on the upper curve side is low in the low and high carbon ranges but very high in the medium carbon range. It is thought that this is because the solidification of single phases, $\delta$ and $\gamma$, in the low and high carbon ranges results in the formation of fewer equiaxed crystals, whereas in the medium carbon range the two-phase solidification, liquid$+\delta$ phase$\rightarrow\gamma$ phase, takes place, so that a long time is expended in the course of this transformation, resulting in the survival of more of the nucleus for equiaxed crystals. It is also thought that the heat locally generated by peritectic reaction remelts the dendrite branches starting at their roots, thereby providing nucleus for equiaxed crystals. The percentage of equiaxed crystal zone corresponds to the distance from the center axis of the cast bloom to the portion where V segregation takes place, expressed in terms of its ratio to the thickness as viewed in the thickness of the cast bloom, and the results of continuous casting under the conditions shown in the figure (v is the cast bloom drawing speed and $\Delta t$ is the superheating of molten steel) have led us to the conclusion that the region where V segregation takes place extends from the center axis up to 45%, preferably 35% of the thickness as viewed in the direction of the thickness of the cast bloom. Thus, we have thought that to attain the object of eliminating said V segregation by electromagnetic stirring, it is necessary to stir said region, and we have reached the conclusion that it is suitable to locate an electromagnetic stirrer at a position nearer to the drawing side in a position where the unsolidified thickness is 45%, preferably 35% of the thickness as viewed in the direction of the thickness of the cast bloom.

For the reason described above, the upper limit of the proportion of the unsolidified thickness to the thickness of the cast slab or bloom is 45%, preferably 35%, while the lower limit must be 15%, preferably 20% for the following reason: The amount of remaining unsolidified molten steel in the cast slab or bloom in the region where the proportion is below said lower limit is relatively small and its temperature has dropped so that the viscosity of the molten steel itself is high, which means that stirring is difficult and that the improvement effect on the quality of the cast slab or bloom is lessened.

Figure 2:
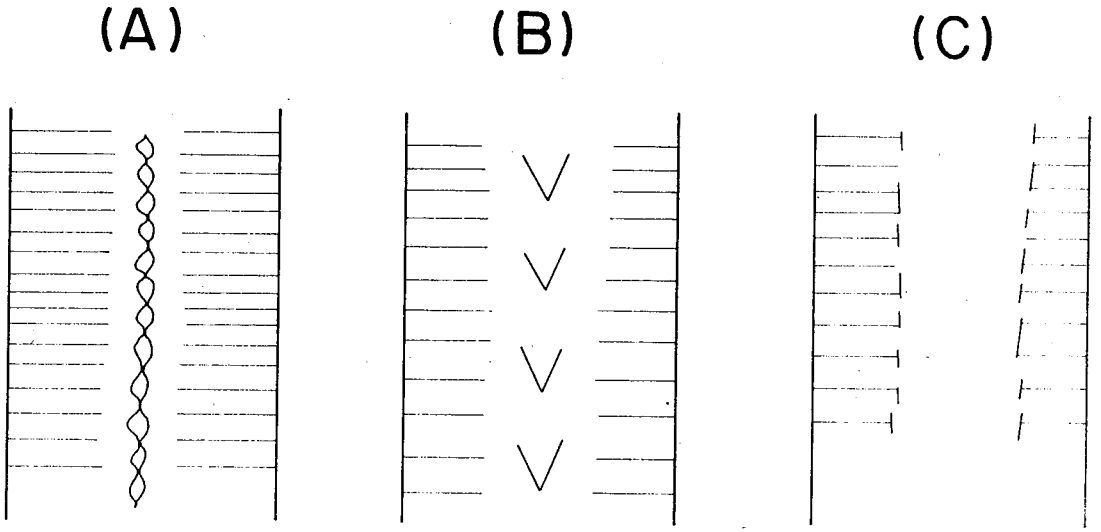
FIG. 2 is a schematic view showing the effect of the present invention.
Figure 3:
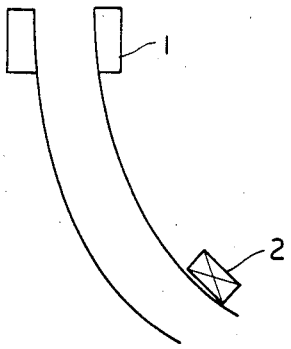
FIGS. 3–7 are schematic views showing how the invention is embodied.
Figure 4:
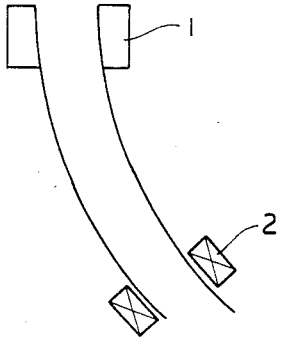
Figure 5:
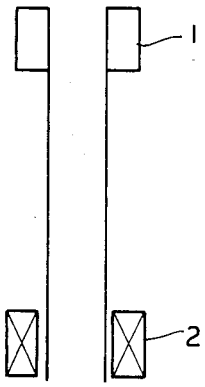
Figure 6:
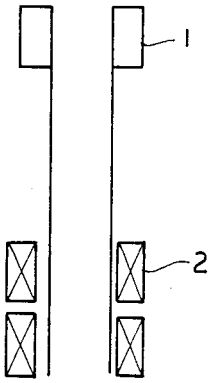
Figure 7:
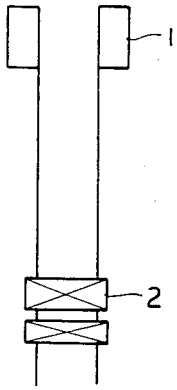

FIG. 2 is a schematic view for explaining a V segregation reducing mechanism according to the present invention, wherein A refers to an instance applying no electromagnetic stirring, B refers to an instance using a conventional electromagnetic stirring technique, and C refers to the present invention; in each case, the cast bloom moves vertically downward. An examination of the macro-structure in the case of A has revealed that columnar crystals extend as far as the center of the cast bloom thickness, forming center porosities at their junction, and in the case of B, equiaxed crystals are multiplied by the breakage of columnar crystals, and the solidified structure in the center part is reduced greatly but not to the extent of eliminating V segregation and micro-porosities. In the case of C according to the method of the invention, however, the V-shaped segregation angle is changed to an extremely sharp angle; in other words, the end edges are successfully turned parallel with the cast bloom surface or oriented in the cast bloom drawing direction. Thus, the electromagnetic stirring according to the invention causes the flow of the V segregation forming region in the casting direction to diffuse rather than gathering toward the center, and more particularly it causes said flow due to the contracting force exerted in the last stage of solidification to be artificially diffused in the direction perpendicular to the cast bloom drawing direction by forming a temperature gradient in said perpendicular direction. Therefore, the segregated liquid formed in the last stage of solidification is circumferentially diffused and solidified without being allowed to V shaped segregation. In addition, such an artificial flow could be produced in the direction opposite to the cast bloom drawing direction, but this is economically disadvantageous from the standpoint of the power source capacity, etc.; thus, advantageously, it should be produced in the cast bloom drawing direction. FIGS. 3–7 are schematic views showing how the present invention is embodied. One or more electromagnetic stirrers 2 are installed at a position nearer to the drawing side than is the position which satisfies said conditions. To attain the intended object of the invention, however, it is necessary to determine more concrete conditions for electromagnetic stirring. We have concluded that the product (B·T) of the magnetic flux density (B gauss) at the solidification interface and the stirring time (T·min.) should be 1,600 gauss·min. per $m^3$ of the volume of the unsolidified molten steel. The circumstances that have led us to this conclusion will now be described on the basis of experimental results.

Table 1 shows conditions in block where in the continuous casting of cast bloom having a cross-section of 380 mm$\times$550 mm, an electromagnetic stirrer having a stirring effective length l of 1,300 mm is installed at a position 13 m (Test No. 1–8) or 17 m (Test No. 9–12) apart from the meniscus [which position statisfies the aforesaid installation condition (45% or less)] and the output is changed. The mm notation in the solidified portion indicates the thickness. For example, the solidification percentage when the casting speed is 0.45 m/min. is calculated as follows.

$$\frac{125+125}{380}\times 100 = 65.8\%$$

Further, the unsolidified volume from the stirrer is calculated as follows, on the assumption that this portion is pyramidal.

$$(0.38-2\times 0.125)\times(0.55-2\times 0.125)\times 17\times\tfrac{1}{3}=0.22\ m^3$$

The gauss values used in the calculations are those shown in Table 2.

TABLE 1

| Test No | Drawing speed V m/min. | Solidified portion mm | Solidified portion % | Unsolidified mass Length (m) | Unsolidified mass Volume ($m^3$) | Stirring time 1,300 mm/V | 250A BT | 500A BT | 750A BT | 1000A BT | 1200A BT | 1800A BT | Remarks |
|---|---|---|---|---|---|---|---|---|---|---|---|---|---|
| | | | | | | | Gauss. min. | | | | | | |
| 1 | 0.45 | 125 | 65.8 | 17.0 | 0.22 | 2.89 min. | 159 | 275 | 405 | 535 | 650 | 867 | Gauss for a shell thickness of 125 mm |
| 2 | 0.5 | 119 | 62.6 | 20.0 | 0.30 | 2.60 | 143 | 247 | 364 | 481 | 585 | 780 | Gauss for a shell thickness of 125 mm |
| 3 | 0.55 | 113 | 59.5 | 23.6 | 0.39 | 2.36 | 130 | 224 | 330 | 437 | 531 | 708 | Gauss for a shell thickness of 125 mm |
| 4 | 0.60 | 108 | 56.8 | 26.9 | 0.49 | 2.17 | 152 | 260 | 401 | 521 | 630 | 825 | Gauss for a shell thickness of 100 mm |
| 5 | 0.65 | 102 | 53.7 | 30.2 | 0.61 | 2.0 | 140 | 240 | 370 | 480 | 580 | 760 | Guass for a shell thickness of 100 mm |
| 6 | 0.70 | 96 | 50.5 | 33.5 | 0.75 | 1.86 | 130 | 223 | 344 | 446 | 539 | 707 | Gauss for a shell thickness of 100 mm |
| 7 | 0.75 | 90 | 47.3 | 36.9 | 0.91 | 1.73 | 121 | 207 | 320 | 415 | 501 | 657 | Gauss for a shell thickness of 100 mm |
| 8 | 0.80 | 85 | 44.7 | 40.0 | 1.06 | 1.63 | 114 | 196 | 302 | 391 | 473 | 619 | |
| 9 | 0.45 | 150 | 78.9 | 13.0 | 0.087 | 2.89 | 88.7 | 178 | 266 | 1000A* 355 | 426 | 639 | |
| 10 | 0.55 | 136 | 71.5 | 19.6 | 0.196 | 2.36 | 100 | 200 | 300 | 400 | 480 | 1500A* 600 720 | |
| 11 | 0.60 | 130 | 68.4 | 22.9 | 0.266 | 2.17 | 81.3 | 102.5 | 243 | 325 | 390 | 1800A* 585 | |
| 12 | 0.55 | 136 | 71.5 | 19.6 | 0.196 | 2.36 | 100 | 200 | 300 | 400 | 1200A* 480 | 720 | |

TABLE 2

| Current Shell thickness | 250A | 500A | 750A | 1000A | 1200A | 1800A |
|---|---|---|---|---|---|---|
| 125 mm | 55 | 95 | 140 | 185 | 225 | 300 |
| 100 mm | 70 | 120 | 185 | 240 | 290 | 380 |

In addition, the magnetic flux density B at the solidification interface is given by the following equation.

$$B = Boe^{-\frac{\tau}{\delta}}$$

where

Bo: the magnetic flux density (gauss on the electromagnetic stirrer surface $\tau$: the pole pitch (mm) in the electromagnetic stirrer $\delta$: the depth of penetration (mm)

$$\delta = 5.04\ \rho/f$$

$\rho$: specific resistance ($\mu$ 6)

f: frequency (Hz)

Figure 8:
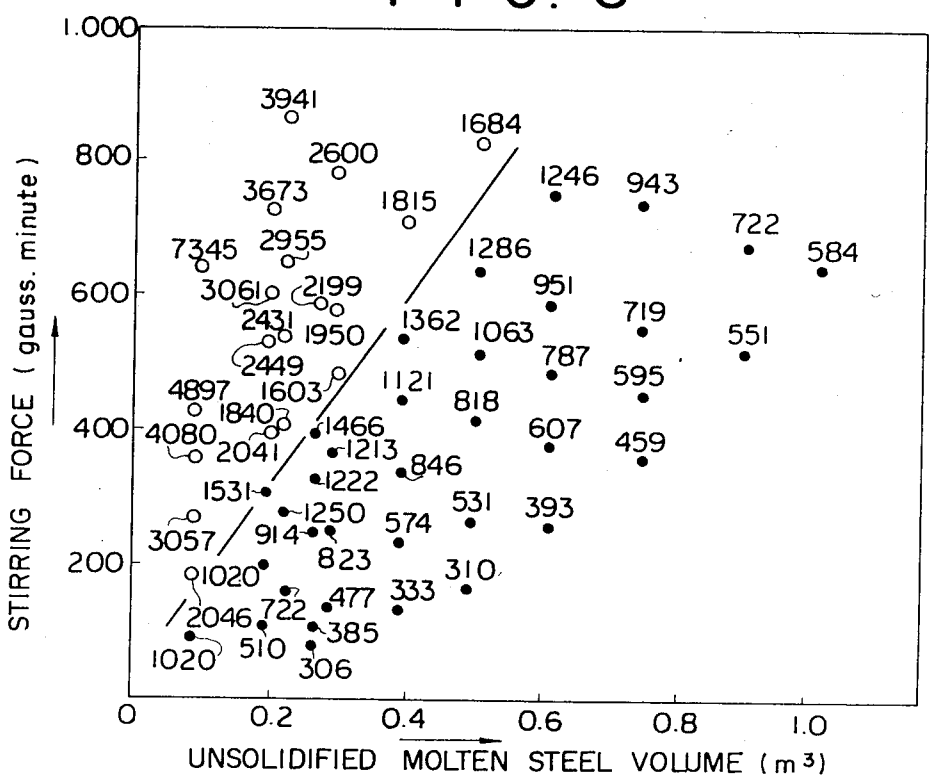
FIG. 8 is a graph showing the relationship between the unsolidified molten steel volume and the stirring force, associated with the presence or absence of the effect of the invention.

FIG. 8 shows the values of Table 1 plotted in a graph, the vertical axis indicating the stirring force (B·T) and the horizontal axis the unsolidified molten steel volume ($mm^3$). The mark o refers to cases where the central V segregation was reduced and the mark ● refers to cases where there was no such effect. The longitudinal/horizontal axis ratio (unit: gauss min/$m^3$) for each plot is also shown in the graph. We have concluded from FIG. 8 that the V segregation reducing effect is remarkable if the value of B·T/$m^3$ is 1,600 or more.

Figure 9:
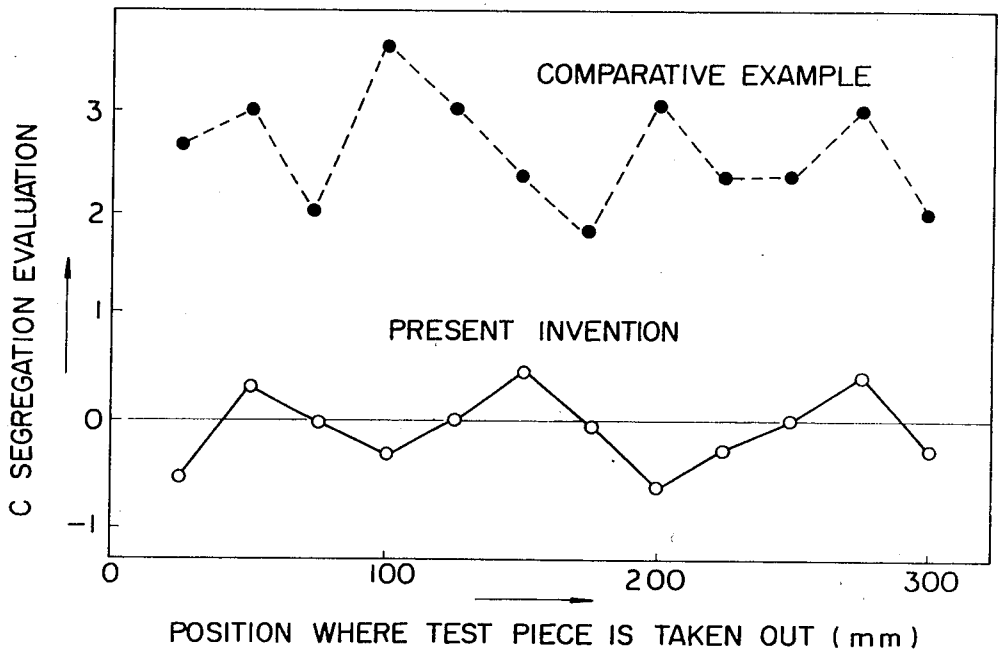
FIG. 9 is a graph showing the effect of the invention on C segregation evaluation.

FIG. 9 shows an example in which a cast bloom with a superheating of molten steel $\Delta T$ of 15°–40° C. and a cross-section of 380×550 (mm) was continuously cast at a casting speed of 0.6 m/min. The mark ● refers to a comparative example using no electromagnetic stirring and the mark o refers to an example of the present invention wherein an electromagnetic stirrer is installed at a position where the unsolidified thickness is 40%. As is clear from the figure, whereas the comparative example exhibited extremely noticeable C segregation, the present inventive example yielded a cast bloom having little C segregation. Further, it did not develop negative segregation, either, nor did it form a white band.

Since the present invention is arranged in the manner described above, it is possible to prevent formation not only of V-shaped segregation in the central portion of the cast bloom but also of negative segregation, thereby successfully improving the mechanical properties of continuously cast products.

What is claimed is:

1. A method for electromagnetically stirring molten steel in continuous casting wherein in producing cast slab and bloom, an electromagnetic stirring force is applied to the unsolidified molten steel in the cast slab and bloom being drawn, said method comprising stirring the unsolidified molten steel in the casting direction with an electromagnetic stirrer, which is located between drawing positions where the unsolidified thickness is 45% and 15%, respectively, of the thickness as viewed in the direction of the thickness of the cast slab and bloom, in such a manner that the product of the magnetic flux density, B, in gauss units, at the interface between the unsolidified and solidified portions, and the stirring time, T, which is defined as the ratio of the stirring effective length (mm) of the electromagnetic stirrer to the casting speed (m/min.), in minute units, is 1,600 gauss-min. or more per $m^3$ of the total volume, of unsolidified molten steel present in a region extending to the drawing side from the position where the electromagnetic stirrer is located.

2. An electromagnetic stirring method as set forth in claim 1, wherein the electromagnetic stirrer is located between drawing positions where the unsolidified thickness is 35% and 20%, respectively, of the thickness as viewed in the direction of the thickness of the cast slab and bloom.

* * * * *